US008958957B2

(12) United States Patent
Hottmann et al.

(10) Patent No.: US 8,958,957 B2
(45) Date of Patent: Feb. 17, 2015

(54) SYSTEM AND METHOD FOR LIMITING SECONDARY TIPPING MOMENT OF AN INDUSTRIAL MACHINE

(75) Inventors: Troy Hottmann, Oconomowoc, WI (US); Mooyoung Lee, Milwaukee, WI (US); Joseph Colwell, Hubertus, WI (US); Michael Linstroth, Port Washington, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 321 days.

(21) Appl. No.: 13/363,273

(22) Filed: Jan. 31, 2012

(65) Prior Publication Data

US 2013/0195595 A1 Aug. 1, 2013

(51) Int. Cl.
*G06F 7/70* (2006.01)

(52) U.S. Cl.
USPC ..... 701/50

(58) Field of Classification Search
None
See application file for complete search history.

(56) References Cited

U.S. PATENT DOCUMENTS

| | | | | |
|---|---|---|---|---|
| 3,648,863 | A | 3/1972 | Baron et al. | |
| 3,934,126 | A | 1/1976 | Zalesov et al. | |
| 4,081,058 | A | 3/1978 | Duriez et al. | |
| 4,261,119 | A | 4/1981 | Kubo et al. | |
| 4,308,489 | A | 12/1981 | Bergmann | |
| 5,361,211 | A | 11/1994 | Lee et al. | |
| 5,408,767 | A | 4/1995 | Hazama et al. | |
| 5,446,981 | A | 9/1995 | Kamada et al. | |
| 5,560,551 | A | 10/1996 | Suverkrop | |
| 6,025,686 | A | 2/2000 | Wickert et al. | |
| 6,466,850 | B1 | 10/2002 | Hilgart | |
| 6,480,773 | B1 | 11/2002 | Hilgart | |
| 6,653,804 | B1 | 11/2003 | Kureck | |
| 7,472,009 | B2 | 12/2008 | Baldwin | |
| 7,610,136 | B2 | 10/2009 | Okamura et al. | |
| 7,734,397 | B2 | 6/2010 | Peterson et al. | |
| 8,798,874 | B2 * | 8/2014 | Taylor | 701/50 |
| 2004/0045289 | A1 | 3/2004 | Ikeda et al. | |
| 2012/0101693 | A1 * | 4/2012 | Taylor | 701/50 |
| 2013/0259625 | A1 * | 10/2013 | Hren | 414/694 |
| 2014/0121840 | A1 | 5/2014 | Mizuochi et al. | |

FOREIGN PATENT DOCUMENTS

| | | |
|---|---|---|
| JP | 2000017692 | 1/2000 |
| WO | 2012169531 | 12/2012 |

OTHER PUBLICATIONS

Patent Examination Report No. 1 from IP Australia for Patent Application No. 2013200540 dated Oct. 14, 2014 (4 pages).

* cited by examiner

*Primary Examiner* — Thomas Tarcza
*Assistant Examiner* — Adam Alharbi
(74) *Attorney, Agent, or Firm* — Michael Best & Friedrich LLP

(57) ABSTRACT

A method of controlling a digging operation of an industrial machine. The industrial machine includes a dipper connected to a dipper handle, a hoist rope attached to the dipper, and a hoist motor moving the hoist rope and the dipper. The method includes determining that the dipper is ready to be unloaded, activating a secondary tipping control operation by controlling a speed of the hoist motor, controlling an acceleration ramp rate of the hoist motor, and controlling a deceleration ramp rate of the hoist motor. The method further includes determining when the dipper is unloaded and deactivating the secondary tipping control operation.

34 Claims, 5 Drawing Sheets

SYSTEM AND METHOD FOR LIMITING SECONDARY TIPPING MOMENT OF AN INDUSTRIAL MACHINE

BACKGROUND

This invention relates to controlling a digging operation of an industrial machine, such as an electric rope or power shovel.

SUMMARY

Industrial machines, such as electric rope or power shovels, draglines, etc., are used to execute digging operations to remove material from, for example, a bank of a mine. These machines and/or their components are generally driven by electric motor(s). Tipping loads adversely affect the life of major machine structures because they greatly contribute to cyclical fatigue loading of these structures. In some situations, primary dynamic tipping occurs during the standard operations of a power shovel with a dipper (e.g., when the shovel is digging in the bank). Further, very high secondary tipping loads can also occur during the dump cycle of the dipper (e.g., when the operator trips and unloads the full dipper into a vehicle). Applying such primary and secondary tipping loads induces the stress in the machine elements. For example, the stress in the hoist system, the hoist attachment, and the overall machine structure is increased due to these tipping loads. This can cause weld cracking and other strains on the entire industrial machine. Limiting the tipping loads of the industrial machine can, therefore, increase the operational life of the machine.

The conventional power shovels are generally not designed to limit the dynamic secondary tipping moment during the time the shovel trips the dipper. The shovel's standard operating parameters are set to achieve balance of speed, reliability, and safety, but these parameters are generally constant regardless of the position of the dipper or the load in the dipper. Since fatigue life is very important to the life of the shovel, limiting the secondary tipping loads of the shovel will eliminate the unnecessary secondary forces during a dump cycle. The described invention seeks to provide a control system and a method that limits the dynamic secondary tipping moment during unloading of the dipper. The proposed method uses information about the shovel's swing speed and the shovel state to limit the hoisting speed and acceleration/deceleration of the hoist motor in order to smooth out the dynamic secondary tipping moment, particularly when an operator lowers a full dipper into the back of a vehicle and then quickly hoists it out while tripping the door.

In one embodiment, the invention provides a method of controlling a digging operation of an industrial machine. The industrial machine includes a dipper connected to a dipper handle, a hoist rope attached to the dipper, and a hoist motor moving the hoist rope and the dipper. The method includes determining that the dipper is ready to be unloaded, activating a secondary tipping control operation by controlling a speed of the hoist motor, controlling an acceleration ramp rate of the hoist motor, and controlling a deceleration ramp rate of the hoist motor. The method further includes determining when the dipper is unloaded and deactivating the secondary tipping control operation.

In another embodiment, the invention provides an industrial machine. The industrial machine includes a dipper handle connected to a dipper, a hoist rope attached to the dipper, a hoist motor drive configured to provide one or more control signals to a hoist motor, the hoist motor operable to provide a force to the hoist rope to move the dipper. The industrial machine further includes a controller connected to the hoist motor drive. The controller is configured to determine that the dipper is ready to be unloaded, activate a secondary tipping control operation to control a speed of the hoist motor, control an acceleration ramp rate of the hoist motor, and control a deceleration ramp rate of the hoist motor. The controller is further configured to determine when the dipper is unloaded and deactivate the secondary tipping control operation.

In yet another embodiment, the invention provides a method of controlling a digging operation of an industrial machine. The industrial machine including a dipper connected to a dipper handle, a hoist rope attached to the dipper, and a hoist motor moving the hoist rope and the dipper. The method includes determining that the dipper is in a position to be unloaded, decreasing a speed of the hoist motor, decreasing an acceleration ramp rate of the hoist motor, decreasing a deceleration ramp rate of the hoist motor, determining when the dipper is tripped, increasing the acceleration ramp rate of the hoist motor, and increasing the deceleration ramp rate of the hoist motor.

Other aspects of the invention will become apparent by consideration of the detailed description and accompanying drawings.

DETAILED DESCRIPTION

Figure 1:
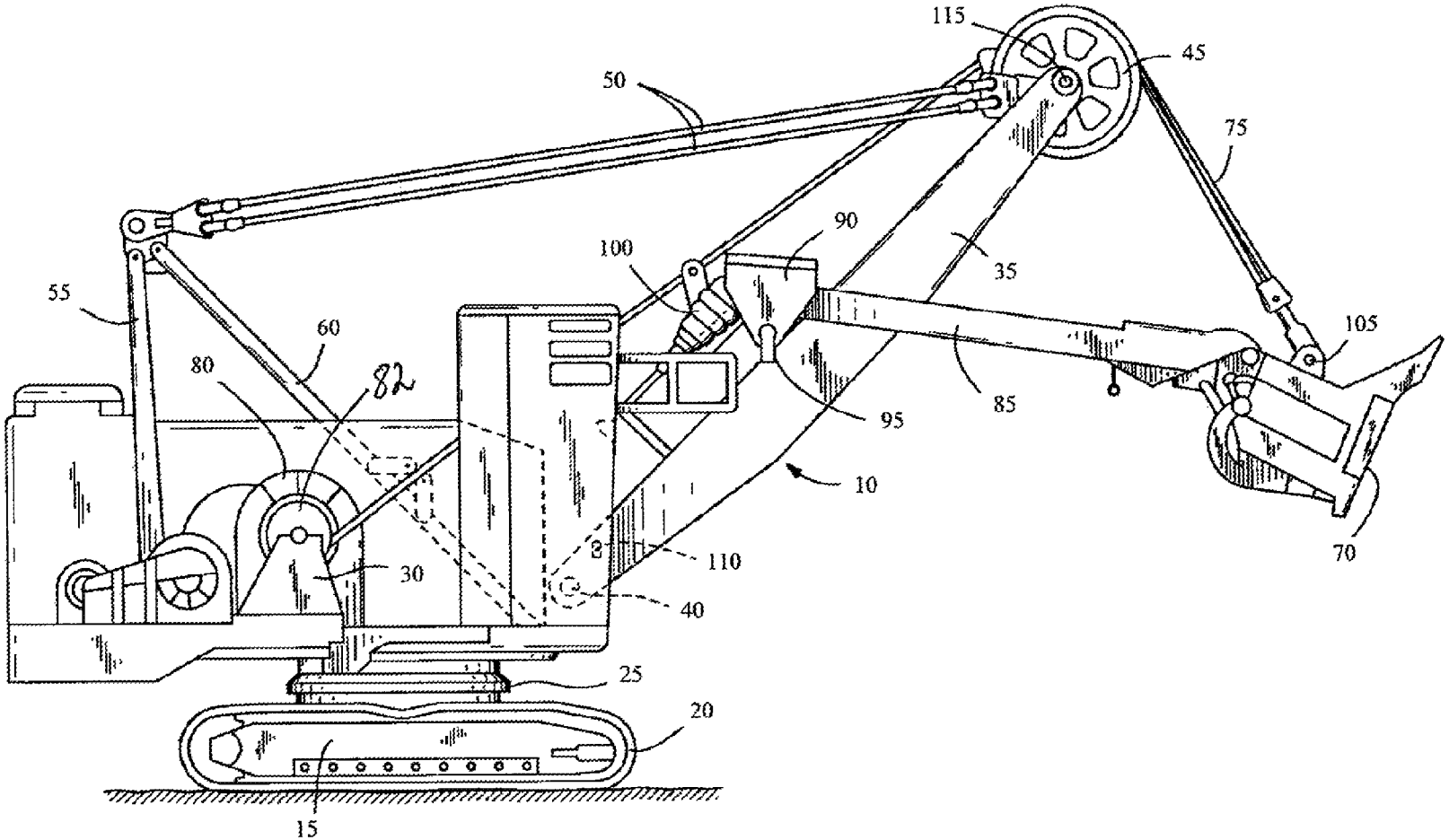
FIG. 1 illustrates an industrial machine according to an embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

It should be noted that a plurality of hardware and software based devices, as well as a plurality of different structural components may be utilized to implement the invention. Furthermore, and as described in subsequent paragraphs, the specific configurations illustrated in the drawings are intended to exemplify embodiments of the invention and that other alternative configurations are possible. The terms "processor" "central processing unit" and "CPU" are interchangeable unless otherwise stated. Where the terms "processor" or "central processing unit" or "CPU" are used as identifying a unit performing specific functions, it should be understood that, unless otherwise stated, those functions can be carried out by a single processor, or multiple processors arranged in any form, including parallel processors, serial processors, tandem processors or cloud processing/cloud computing configurations.

The invention described herein relates to systems, methods, devices, and computer readable media associated with the control of the dynamic secondary tipping moment of an industrial machine during the unloading of the machine's dipper. The industrial machine, such as an electric rope shovel or similar mining machine, is operable to execute a digging operation to remove a payload (i.e. material) from a bank. After the material is captured by the dipper, the operator swings the shovel to position the dipper over a discharge location (e.g., a loading vehicle or a conveyor line). Tripping and unloading the full dipper into the loading vehicle can cause tipping loads that in extreme situations can lead to overturning. These tipping loads can increase the peak hoist torques of the hoist motor pulling the dipper. This causes spikes in the tipping loads that contribute to structural fatigue and stresses that can adversely affect the operational life of the industrial machine.

In order to limit the secondary tipping loads of the industrial machine, a controller of the industrial machine controls the hoisting speed and acceleration/deceleration of the hoist motor in order in order to limit the peak hoist torques of the machine. Specifically, the controller uses information about the shovel's swing speed and the shovel state to determine when the dipper handle is extended and the dipper is ready to be unloaded. Then, the controller limits the excessive hard deceleration and acceleration of the dipper before and after tripping the dipper by controlling the hoist motor. Controlling the operation of the industrial machine in such a manner during a digging operation limits the damaging effects of tipping loading that commonly occur during the dumping cycle of the industrial machine.

Although the invention described herein can be applied to, performed by, or used in conjunction with a variety of industrial machines (e.g., a rope shovel, a dragline with hoist and drag motions, etc.), embodiments of the invention described herein are described with respect to an electric rope or power shovel, such as the power shovel 10 shown in FIG. 1. The shovel 10 includes a mobile base 15, drive tracks 20, a turntable 25, a machinery deck 30, a boom 35, a lower end 40, a sheave 45, tension cables 50, a back stay 55 (also called a tension member), a gantry structure 60, a dipper 70, one or more hoist ropes 75, a winch drum 80, dipper arm or handle 85, a saddle block 90, a pivot point 95, a transmission unit 100, a bail pin 105, an inclinometer 110, and a sheave pin 115.

The mobile base 15 is supported by the drive tracks 20. The mobile base 15 supports the turntable 25 and the machinery deck 30. The turntable 25 is capable of 360-degrees of rotation about the machinery deck 30 relative to the mobile base 15. The boom 35 is pivotally connected at the lower end 40 to the machinery deck 30. The boom 35 is held in an upwardly and outwardly extending relation to the deck by the tension cables 50 which are anchored to the back stay 55 of the gantry structure 60. The gantry structure 60 is rigidly mounted on the machinery deck 30, and the sheave 45 is rotatably mounted on the upper end of the boom 35.

The dipper 70 is suspended from the boom 35 by the hoist rope(s) 75. The hoist rope 75 is wrapped over the sheave 45 and attached to the dipper 70 at the bail pin 105. The hoist rope 75 is anchored to the winch drum 80 of the machinery deck 30. The winch drum 80 is driven by at least one an electric motor 82 that incorporates a transmission unit (not shown). As the winch drum 80 rotates, the hoist rope 75 is paid out to lower the dipper 70 or pulled in to raise the dipper 70. The dipper handle 85 is also rigidly attached to the dipper 70. The dipper handle 85 is slidably supported in a saddle block 90, and the saddle block 90 is pivotally mounted to the boom 35 at the pivot point 95. The dipper handle 85 includes a rack tooth formation thereon which engages a drive pinion mounted in the saddle block 90. The drive pinion is driven by an electric motor and transmission unit 100 to extend or retract the dipper arm 85 relative to the saddle block 90.

An electrical power source is mounted to the machinery deck 30 to provide power to the hoist electric motor 82 for driving the winch drum 80, one or more crowd electric motors for driving the saddle block transmission unit 100, and one or more swing electric motors for turning the turntable 25. Each of the crowd, hoist, and swing motors can be driven by its own motor controller or drive in response to control signals from a controller, as described below.

Figure 2:
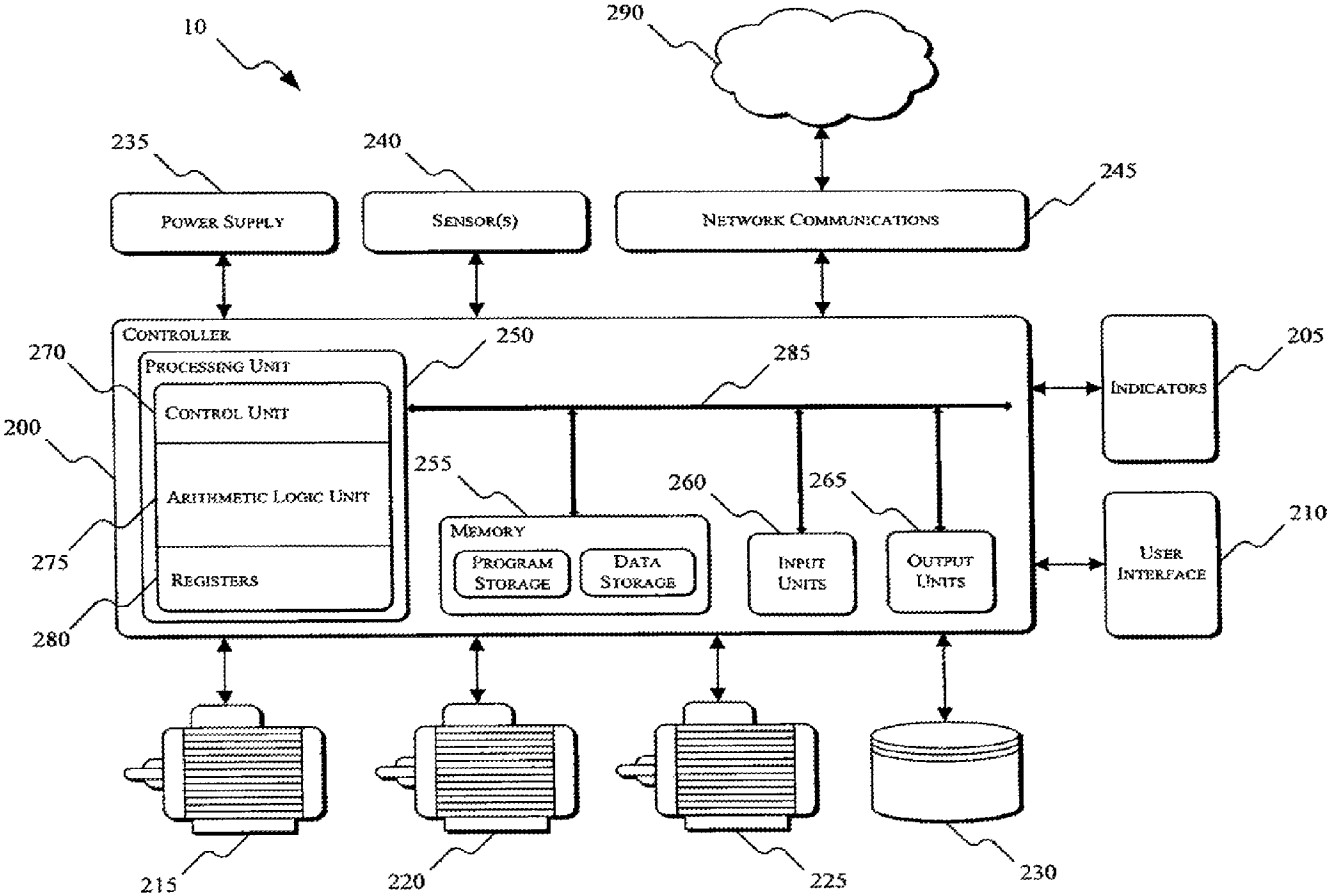
FIG. 2 illustrates a controller for an industrial machine according to an embodiment of the invention.

FIG. 2 illustrates a controller 200 associated with the power shovel 10 of FIG. 1. The controller 200 is electrically and/or communicatively connected to a variety of modules or components of the shovel 10. For example, the illustrated controller 200 is connected to one or more indicators 205, a user interface module 210, one or more hoist motors and hoist motor drives 215, one or more crowd motors and crowd motor drives 220, one or more swing motors and swing motor drives 225, a data store or database 230, a power supply module 235, one or more sensors 240, and a network communications module 245. The controller 200 includes combinations of hardware and software that are operable to, among other things, control the operation of the power shovel 10, control the position of the boom 35, the dipper arm 85, the dipper 70, etc., activate the one or more indicators 205 (e.g., a liquid crystal display ["LCD"]), monitor the operation of the shovel 10, etc. The one or more sensors 240 include, among other things, position sensors, velocity sensors, speed sensors, acceleration sensors, the inclinometer 110, one or more motor field modules, etc. For example, the position sensors are configured to detect the position of the shovel 25 (i.e., if the shovel is swinging), the position of the dipper handle 85 and the dipper 70 and to provide the information to the controller 200. Further, the speed and acceleration sensors are configured to detect the speed and the acceleration of the hoist motor 82 and the swing motor and to provide that information to the controller 200.

In some embodiments, the controller 200 includes a plurality of electrical and electronic components that provide power, operational control, and protection to the components and modules within the controller 200 and/or shovel 10. For example, the controller 200 includes, among other things, a processing unit 250 (e.g., a microprocessor, a microcontroller, or another suitable programmable device), a memory 255, input units 260, and output units 265. The processing unit 250 includes, among other things, a control unit 270, an arithmetic logic unit ("ALU") 275, and a plurality of registers 280 (shown as a group of registers in FIG. 2), and is implemented using a known computer architecture. The processing unit 250, the memory 255, the input units 260, and the output units 265, as well as the various modules connected to the controller 200 are connected by one or more control and/or data buses (e.g., common bus 285). The control and/or data buses are shown generally in FIG. 2 for illustrative purposes. The use of one or more control and/or data buses for the interconnection between and communication among the various modules and components would be known to a person skilled in the art in view of the invention described herein. In some embodiments, the controller 200 is implemented partially or entirely on a semiconductor (e.g., a field-programmable gate array ["FPGA"] semiconductor) chip, such as a chip developed through a register transfer level ("RTL") design process.

The memory 255 includes, for example, combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD card, or other suitable magnetic, optical, physical, or electronic memory devices. The processing unit 250 is connected to the memory 255 and executes software instructions that are capable of being stored in a RAM of the memory 255 (e.g., during execution), a ROM of the memory 255 (e.g., on a generally permanent basis), or another non-transitory computer readable medium such as another memory or a disc. Software included in the implementation of the shovel 10 can be stored in the memory 255 of the controller 200. The software includes, for example, firmware, one or more applications, program data, filters, rules, one or more program modules, and other executable instructions. The controller 200 is configured to retrieve from memory and execute, among other things, instructions related to the control processes and methods described herein. In other constructions, the controller 200 includes additional, fewer, or different components.

The network communications module 245 is connectable to and can communicate through a network 290. In some embodiments, the network is, for example, a wide area network ("WAN") (e.g., a TCP/IP based network, a cellular network, such as, for example, a Global System for Mobile Communications ["GSM"] network, a General Packet Radio Service ["GPRS"] network, a Code Division Multiple Access ["CDMA"] network, an Evolution-Data Optimized ["EV-DO"] network, an Enhanced Data Rates for GSM Evolution ["EDGE"] network, a 3GSM network, a 4GSM network, a Digital Enhanced Cordless Telecommunications ["DECT"] network, a Digital AMPS ["IS-136/TDMA"] network, or an Integrated Digital Enhanced Network ["iDEN"] network, etc.).

In other embodiments, the network 290 is, for example, a local area network ("LAN"), a neighborhood area network ("NAN"), a home area network ("HAN"), or personal area network ("PAN") employing any of a variety of communications protocols, such as Wi-Fi, Bluetooth, ZigBee, etc. Communications through the network 290 by the network communications module 245 or the controller 200 can be protected using one or more encryption techniques, such as those techniques provided in the IEEE 802.1 standard for port-based network security, pre-shared key, Extensible Authentication Protocol ("EAP"), Wired Equivalency Privacy ("WEP"), Temporal Key Integrity Protocol ("TKIP"), Wi-Fi Protected Access ("WPA"), etc. The connections between the network communications module 245 and the network 290 are, for example, wired connections, wireless connections, or a combination of wireless and wired connections. Similarly, the connections between the controller 200 and the network 290 or the network communications module 245 are wired connections, wireless connections, or a combination of wireless and wired connections. In some embodiments, the controller 200 or network communications module 245 includes one or more communications ports (e.g., Ethernet, serial advanced technology attachment ["SATA"], universal serial bus ["USB"], integrated drive electronics ["IDE"], etc.) for transferring, receiving, or storing data associated with the shovel 10 or the operation of the shovel 10.

The power supply module 235 supplies a nominal AC or DC voltage to the controller 200 or other components or modules of the shovel 10. The power supply module 235 is powered by, for example, a power source having nominal line voltages between 100V and 240V AC and frequencies of approximately 50-60 Hz. The power supply module 235 is also configured to supply lower voltages to operate circuits and components within the controller 200 or shovel 10. In other constructions, the controller 200 or other components and modules within the shovel 10 are powered by one or more batteries or battery packs, or another grid-independent power source (e.g., a generator, a solar panel, etc.).

The user interface module 210 is used to control or monitor the power shovel 10. For example, the user interface module 210 is operably coupled to the controller 200 to control the position of the dipper 70, the position of the boom 35, the position of the dipper handle 85, the motor 82, etc. The user interface module 210 includes a combination of digital and analog input or output devices required to achieve a desired level of control and monitoring for the shovel 10. For example, the user interface module 210 includes one or more joysticks, a display (e.g., a primary display, a secondary display, etc.), and input devices such as touch-screen displays, a plurality of knobs, dials, switches, buttons, etc. The display is, for example, a liquid crystal display ("LCD"), a light-emitting diode ("LED") display, an organic LED ("OLED") display, an electroluminescent display ("ELD"), a surface-conduction electron-emitter display ("SED"), a field emission display ("FED"), a thin-film transistor ("TFT") LCD, etc. The user interface module 210 can also be configured to display conditions or data associated with the power shovel 10 in real-time or substantially real-time. For example, the user interface module 210 is configured to display measured electrical characteristics of the power shovel 10, the status of the motor 82, the status of the power shovel 10, the position of the dipper 70, the position of the dipper handle 85, etc. In some implementations, the user interface module 210 is controlled in conjunction with the one or more indicators 205 (e.g., LEDs, speakers, etc.) to provide visual or auditory indications of the status or conditions of the power shovel 10.

The processor 250 of the controller 200 sends control signals to control the operations of the shovel 10. For example, the controller 200 can control, among others, the digging, dumping, hoisting, crowding, and swinging operations of the shovel 10. The control signals sent by the controller 200 are associated with drive signals for hoist, crowd, and swing motors 215, 220, and 225 of the shovel 10. As the drive signals are applied to the motors 215, 220, and 225, the outputs (e.g., electrical and mechanical outputs) of the motors are monitored and fed back to the controller 200. The outputs of the motors include, for example, motor speed, motor torque, motor power, motor current, etc. Based on these and other signals associated with the shovel 10 (e.g., signals from the sensors 240), the controller 200 is configured to determine or calculate one or more operational states or positions of the shovel 10 or its components.

In some embodiments, the controller 200 determines the following shovel states—digging state, swing state, full plug generation state, dump state, and return state. In other embodiments, the controller can determine more or fewer shovel states. The digging state of the shovel 10 indicates that the shovel is currently digging in the bank of material. The swing state of the shovel 10 indicates that the shovel is in a swing motion (i.e., the swing motor 225 is rotating the turntable 25 and consequently the machinery deck 30 of the shovel 10). Generally, the shovel 10 is in a swing state when the operator is swinging the shovel to position the dipper 75 over a loading vehicle. The full plug generation state of the shovel 10 indicates that the operator is requesting a full deceleration of the swing speed of the shovel. Generally, this occurs when the dipper is positioned over the loading vehicles. The dump state of the shovel 10 indicates that the operator is unloading the dipper. The return state of the shovel 10 indicates that the material from the dipper 70 is unloaded and that the shovel is returning towards the bank of material to begin another dig cycle.

Further, the controller 200 determines various conditions of the shovel 10 or its components. For example, the controller 200 determines the operational status of the hoist, swing, or crowd motors, a hoist rope wrap angle, a hoist motor rotations per minute ("RPM"), a crowd motor RPM, a hoist motor acceleration/deceleration, etc. In addition, the controller 200 uses hoist load calculation software to determine when the dipper 75 is full and ready to be unloaded. Also, the controller 200 is configured to determine the position of the dipper handle 85 (e.g., is the dipper handle 85 extended in relation to the boom 35). In one embodiment, the controller can determine the level of extension (e.g., in percentage) of the dipper handle 85. For example, the controller 200 can compare the current position of the dipper handle 85 with a predetermined handle threshold value (e.g., where the maximum value is equal to 100% or fully extended handle) to determine that the handle is in a position to dig or unload the dipper 70 (e.g., when the handle threshold value is at 75% or more). The controller 200 is also configured to determine a dipper handle angle (not shown). In one embodiment, the dipper handle angle is determined in relation to a horizontal plane (not shown) that is positioned at 90 degrees in relation to pivot point 95.

The controller 200 and the control system of the shovel 10 described above are used to implement a secondary tipping control ("SOTC") for the shovel 10. SOTC is used to control the secondary tipping loads of the shovel 10 during the unloading of the shovel's dipper 75. Controlling and reducing secondary tipping loads of the shovel 10 reduces structural fatigue on various components of the shovel 10 (e.g., the hoist motor 82, the hoist ropes 75, the mobile base 15, the turntable 25, the machinery deck 30, the lower end 40, etc.). For example, SOTC is configured to monitor various components of the shovel 10 to determine that the shovel 10 is ready to be unloaded. Then, SOTC limits the hoisting speed and acceleration/deceleration of the hoist motor in order to smooth out the dynamic secondary tipping moment, particularly when the operator lowers the full dipper into the back of a vehicle and then quickly hoists it out while tripping the dipper door.

Figure 3:
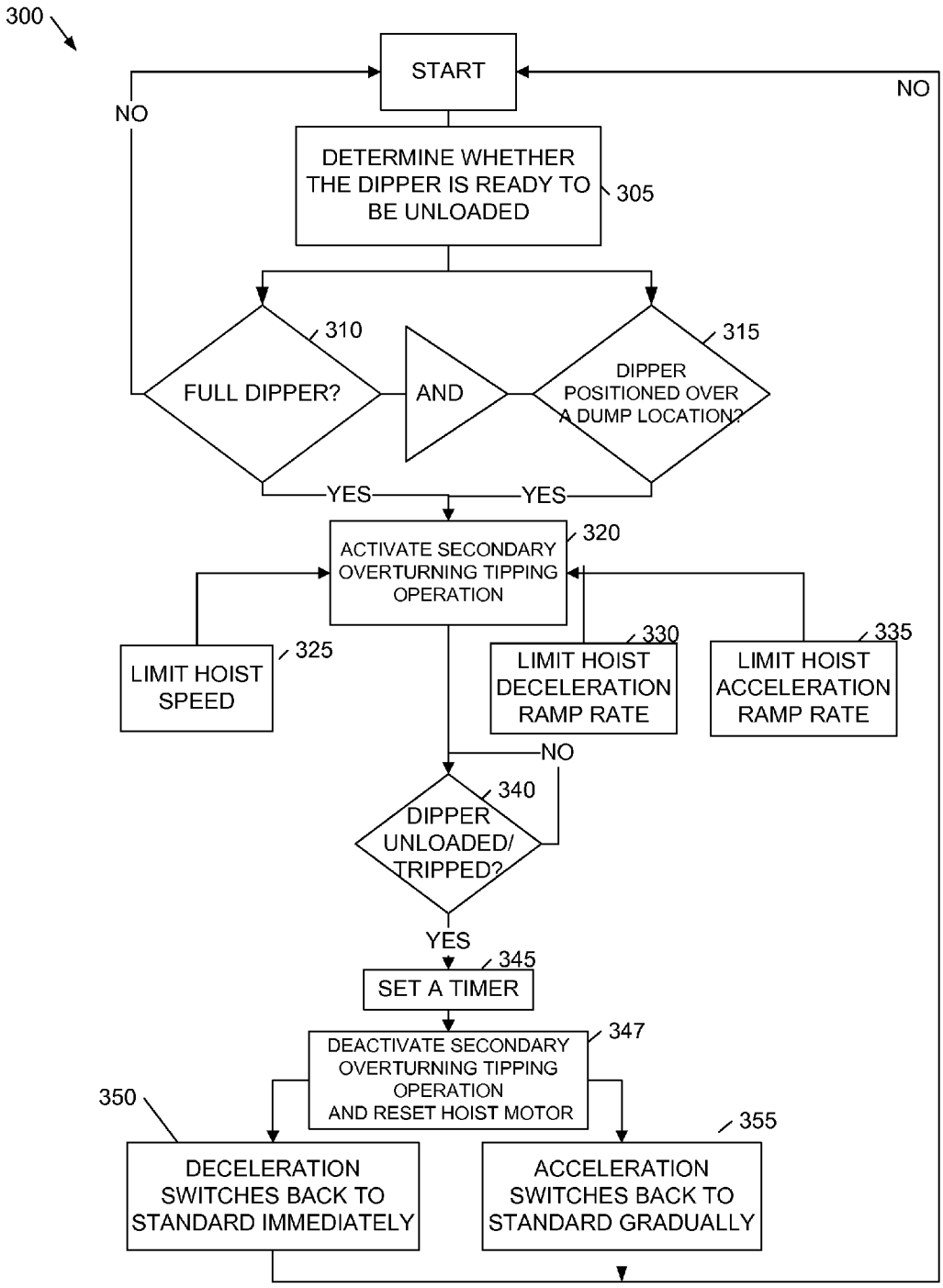
FIG. 3 illustrates a process for controlling an industrial machine according to an embodiment of the invention.

An implementation of SOTC for the shovel 10 is illustrated with respect to the process 300 of FIG. 3. The process 300 is associated with and described herein with respect to a digging operation and secondary tipping created during the unloading of the collected material. The process 300 is illustrative of an embodiment of SOTC and can be executed by the controller 200. Various steps described herein with respect to the process 300 are capable of being executed simultaneously, in parallel, or in an order that differs from the illustrated serial manner of execution. The process 300 is also capable of being executed using additional or fewer steps than are shown in the illustrated embodiment. The steps of the process 300 related to, for example, determining a swing speed, determining a hoist acceleration/deceleration, etc., are accomplished using the one or more sensors 240 that can be processed and analyzed using instructions executed by the controller 200 to determine a value for the characteristic of the shovel 10.

As shown in FIG. 3, the process 300 for SOTC begins with determining whether the dipper 70 is ready to be unloaded (at step 305). In some embodiments, determining whether the dipper is ready to be unloaded includes determining that the dipper 70 is full (at step 310) and that the dipper 70 is positioned over a dump location (e.g., a vehicle, conveyor, crusher, etc.) (at step 315). For example, the controller 200 uses the hoist load calculation software to determine that the dipper 70 is full. The hoist load calculation software uses sensor information about the dipper's position and the rotations per minute ("RPM") of the hoist motor to calculate the amount of material in the dipper and to determine when the dipper is full. Further, the controller 200 uses information about the swing speed of the shovel 10 and information about the status of the shovel to determine when the shovel is positioned over a vehicle. In one embodiment, if the RPM of the swing motor is greater than a predetermined threshold (e.g., 300 RPM) and the shovel 10 is in a full plug generation state, the controller 200 determines that the shovel is positioned over a vehicle. The swing speed of the shovel 10 indicates that the operator is swinging the shovel 10 to position it over a vehicle and the full plug generation state indicates that the operator is requesting a full deceleration of the swing speed (i.e., the dipper is appropriately positioned).

If the dipper 70 is not full or the dipper is not positioned over a vehicle, the process 300 returns to its starting point. If, on the other hand, the dipper 70 is full, the swing speed exceeds the predefined threshold, and the shovel 10 is in a full plug generation state, the process proceeds to step 320. At step 320, the process 300 initiates a secondary tipping control operation of the shovel 10. The goal of this operation is to control the secondary tipping created during the unloading of the material in the dipper 70. In one embodiment, during the secondary tipping control operation, the controller 200 controls the speed, the acceleration, and the deceleration of the hoist motor 215. Specifically, the controller 200 limits the speed of the hoist motor (at 325), limits the acceleration ramp rate of the hoist motor (at 330), and limits the deceleration ramp rate of the hoist motor (at 335). By limiting the speed, the acceleration, and the deceleration of the hoist motor before unloading the dipper 70, the controller 200 limits the secondary tipping moment that is generally created during the unloading of the dipper.

At step 340, the process 300 determines whether the dipper 75 is tripped or unloaded. In one embodiment, the controller 200 monitors the dipper trip button (not shown) of the shovel 10 to determine when the dipper is unloaded/tripped (e.g., the controller monitors when the dipper trip button is pressed or is on). In other embodiments, the controller 200 can determine that the dipper 70 is unloaded by analyzing other components of the shovel 10. If the dipper 70 is not unloaded, the process 300 continues to check for that action (at step 340). If, on the other hand, the dipper 70 is unloaded, the process proceeds to step 345.

At step 345, the controller 200 starts a predetermined timer for initiating the secondary tipping control operation. In one embodiment, the predetermined timer is set at two seconds. In other embodiments, the timer can be set for different periods of time. After the time set in the timer passes, the controller deactivates the secondary tipping control operation by resetting the hoist motor 215 of the shovel 10 to its standard operating levels (at step 347). In some embodiments, the controller 200 is configured to immediately return (i.e., increase) the deceleration ramp rate of the hoist motor 215 to its standard operating level (at step 350). Further, the controller 200 is configured to gradually return (i.e., increase) the acceleration ramp rate of the hoist motor 215 to its standard operating level (at step 355). In one embodiment, the controller 200 uses a derivative function to ramp the acceleration ramp rate back to the standard level. In that embodiment, the controller 200 receives a specific time base input for the derivate in the function. The acceleration ramp rate of the hoist motor increases gradually in case the operator of the shovel 10 requests hoist acceleration at the same time as controller 200 increases the hoist acceleration to its standard level. Therefore, the controller avoids an unexpected acceleration request and a situation where the dipper 70 will accelerate too fast and operator will not be able to respond to this acceleration.

Figure 4:
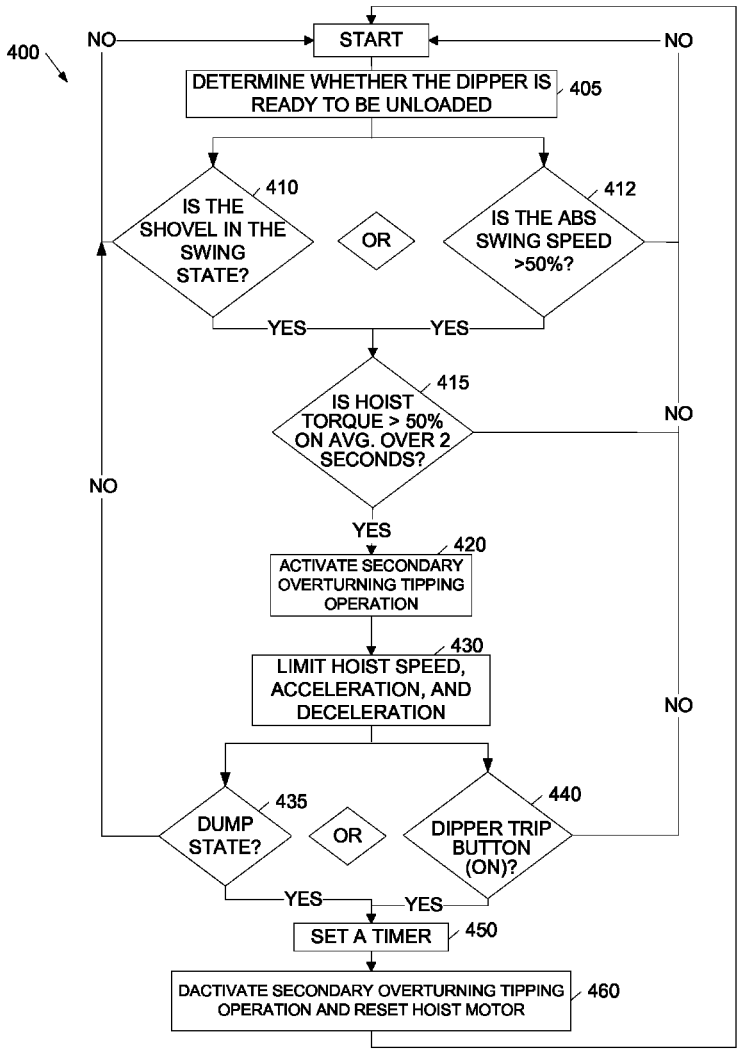
FIG. 4 illustrates an alternative process for controlling an industrial machine according to another embodiment of the invention.

FIG. 4 illustrates an alternative process 400 of SOTC for the shovel 10. The process 400 is illustrative of another embodiment of SOTC and can be executed by the controller 200. As explained below, some of the steps in the process 400 are similar to the steps of the process 300. As shown in FIG. 4, the process 400 for SOTC begins with determining whether the dipper 70 is ready to be unloaded (at step 405). In some embodiments, determining whether the dipper is ready to be unloaded includes determining that the shovel 10 is swinging towards an unloading vehicle (at steps 410 and 412) and that the dipper 70 is full (at step 415). For example, the controller 200 uses the state of the shovel 10 or information of the shovel's swing speed to determine that the shovel is swinging. In one embodiment, if the shovel 10 is in a swing state (at step 410) or if the swing speed of the shovel exceeds a predetermined threshold, (e.g., 50% of the maximum swing speed) (at step 412), the controller 200 determines that the shovel 10 is swinging towards a vehicle. Further, if the torque produced by the hoist motor is greater than a predetermined threshold, (e.g., 50% of the maximum hoist torque) on average over a specific time frame (e.g., two seconds), the controller 200 determines that the dipper is full.

If the dipper 70 is not full or the shovel is not swinging towards a vehicle, the process 400 returns to its starting point. If, on the other hand, the dipper 70 is full and the shovel is swinging, the process proceeds to step 420. At step 420, the process 400 initiates the secondary tipping control operation of the shovel 10. The secondary tipping control operation is similar to the operation described with respect to the method 300. In one embodiment, during the secondary tipping control operation, the controller 200 limits the speed of the hoist motor, the acceleration ramp rate of the hoist motor, and the deceleration ramp rate of the hoist motor (at 430). Next, the controller determines whether the dipper 70 is unloaded or tripped. In one embodiment, the controller 200 evaluates the state of the shovel (at 435) or monitors the dipper trip button (at step 440) of the shovel 10 to determine when the dipper is unloaded/tripped. For example, when the shovel is in a dump state or when the dipper trip button is on, the controller 200 determines that the dipper 70 is tripped or unloaded.

At step 450, the controller 200 starts a predetermined timer for the secondary tipping control operation. After the time set in the timer passes, the controller deactivates the secondary tipping control operation by resetting the hoist motor 215 of the shovel 10 to its standard operating levels (at step 460). Similar to the process 300, in some embodiments, the controller 200 immediately returns (i.e., increases) the deceleration ramp rate of the hoist motor 215 to its standard operating level. Further, the controller 200 gradually returns (i.e., increases) the acceleration ramp rate of the hoist motor 215 to its standard operating level. By limiting the speed, the acceleration, and the deceleration of the hoist motor before and after tripping the dipper 70, the controller 200 limits the secondary tipping that is generally created during the unloading of the dipper.

Figure 5:
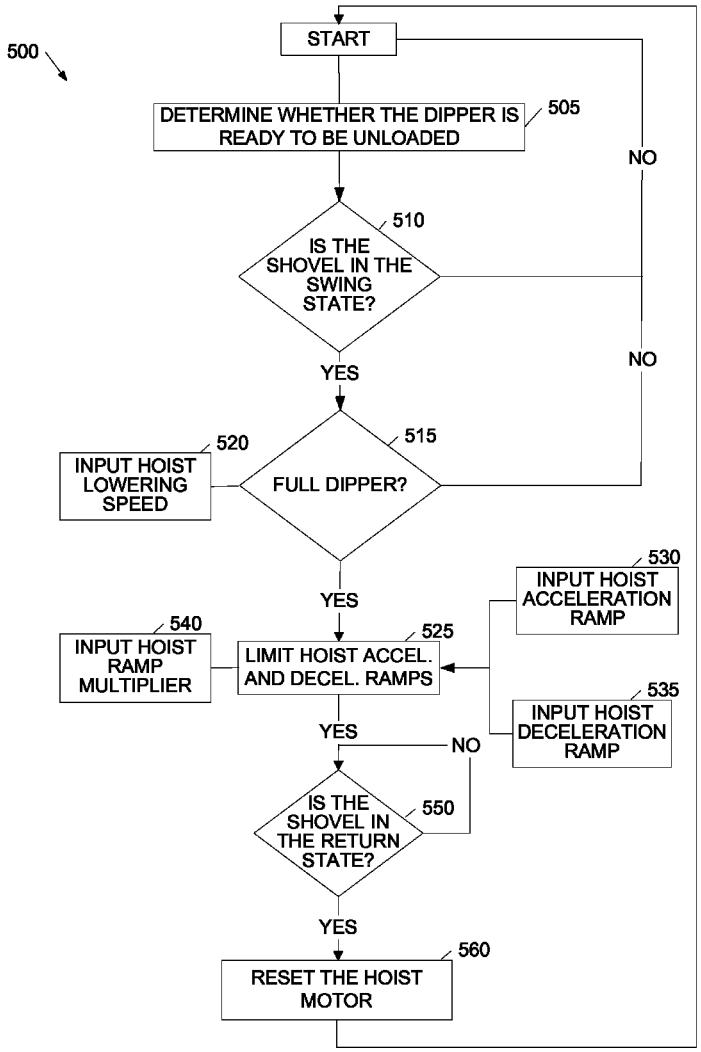
FIG. 5 illustrates an alternative process for controlling an industrial machine according to yet another embodiment of the invention.

FIG. 5 illustrates another alternative process 500 of SOTC for the shovel 10. The process 500 is illustrative of another embodiment of SOTC and can be executed by the controller 200. As explained below, some of the steps in the process 500 are similar to the steps of the processes 300 and/or 400. The main difference between the process 500 and the previously described SOTC processes is that in the process 500 the values of the secondary tipping control operation parameters (e.g., the hoist speed, acceleration, and deceleration) are modifiable by the shovel operator. In other words, the operator of the shovel can adjust these operation parameters during the unloading stage of the dipper, where in the processes 300 and 400 these parameters are fixed (i.e., stored as fixed values in the memory) and can not be modified by the operator.

As shown in FIG. 5, the process 500 for SOTC begins with determining whether the dipper 70 is ready to be unloaded (at step 505). In some embodiments, this includes determining that the shovel 10 is swinging towards an unloading vehicle (at steps 510) and that the dipper 70 is full (at step 515). As explained above, the controller 200 uses the state of the shovel 10 to determine that the shovel is swinging (i.e., monitors when the shovel 10 is in a swing state). Further, the controller 200 can use the hoist load calculation software to determine that the dipper 70 is full. In addition, prior to the beginning of a dig cycle, the operator can lower the hoist lowering speed by inputting specific parameters (at 520). The operator's input is transferred to the controller 200 and the controller 200 limits the speed of the hoist motor 215 as directed by the operator.

After the controller 200 determines that the dipper 70 is full, the process continues to step 525. In step 525, the controller 200 limits the acceleration ramp rate and the deceleration ramp rate of the hoist motor. For example, prior to the beginning of a dig cycle, the operator uses the user interface module 210 to input specific values for the acceleration ramp rate (at step 530), the deceleration ramp rate (at step 535), and a hoist ramp multiplier (at step 540) to the controller 200. By limiting the hoisting speed and the acceleration/deceleration of the hoist motor, the controller 200 limits the secondary tipping moment that is created when the operator trips the dipper. At the next step, the controller determines whether the dipper 70 is unloaded or tripped. In one embodiment, the controller 200 evaluates the state of the shovel (at step 550) to determine when the dipper is unloaded/tripped. For example, when the shovel is in a return state, the controller 200 determines that the dipper 70 is tripped or unloaded.

At step 550, the controller 200 resets the hoist motor 215 to its standard operating levels. Similar to the previously described processes, the controller 200 immediately returns (i.e., increases) the deceleration ramp rate of the hoist motor 215 to its standard operating level. Further, the controller 200 gradually returns (i.e., increases) the acceleration ramp rate of the hoist motor 215 to its standard operating level.

In other embodiments of the invention, the controller 200 can determine that the dipper 70 is ready to be unloaded and can active the secondary tipping control operation of the SOTC based on different parameters of the shovel 10. For example, the controller 200 can use existing software of the shovel 10 to determine the position of the dipper 70 at all times. This software monitors the position of the dipper 70 and classifies the position of the dipper according to predetermined sections or zones. In one embodiment, using information from the sensors 240 and the existing software, the controller 200 can determine that the dipper is positioned in a "dipper over a truck zone." If the controller 200 determines that the dipper 200 is in this zone and the controller 200 also detects a predetermined level of hoist torque, the controller 200 determines that the dipper is ready to be unloaded (i.e., is positioned over a truck) and can activate the secondary tipping control operation.

In yet another embodiment, the controller 200 can determine that the dipper 70 is ready to be unloaded and can activate the secondary tipping control operation of the SOTC based on the level of extension of the dipper handle 85 and the dipper handle angle. For example, when the controller determines that the dipper handle 85 is extended over a predetermined handle threshold value (e.g., 75% from the fully extended handle) and that the dipper handle angle exceeds a predetermined level, the controller 200 determines that the dipper is ready to be unloaded and can activate the secondary tipping control operation.

What is claimed is:

1. A method of controlling a digging operation of an industrial machine, the industrial machine including a dipper connected to a dipper handle, a hoist rope attached to the dipper, and a hoist motor moving the hoist rope and the dipper, the method comprising:

determining that the dipper is ready to be unloaded;

activating a secondary tipping control operation by controlling a speed of the hoist motor, controlling an acceleration ramp rate of the hoist motor, controlling a deceleration ramp rate of the hoist motor;

determining when the dipper is unloaded; and deactivating the secondary tipping control operation.

2. The method of claim 1, wherein determining that the dipper is ready to be unloaded further includes determining that the dipper is full.

3. The method of claim 2, further comprising using a hoist load calculation program to determine that the dipper is full.

4. The method of claim 1, wherein determining that the dipper is ready to be unloaded further includes determining that a swing speed of the industrial machine is greater than a predetermined threshold.

5. The method of claim 1, wherein determining that the dipper is ready to be unloaded further includes determining that the industrial machine is at a full plug generation state.

6. The method of claim 5, wherein the operator is requesting a full deceleration of the swing speed of the industrial machine during the full plug generation state.

7. The method of claim 5, wherein the full plug generation state indicates that the dipper is positioned over an unloading vehicle.

8. The method of claim 1, wherein determining that the dipper is ready to be unloaded further includes determining that the industrial machine is in a swing state.

9. The method of claim 1, wherein determining that the dipper is ready to be unloaded further includes determining that a hoist torque of the hoist motor is greater than fifty percent on average for a predetermined time period.

10. The method of claim 1, further comprising starting a predetermined timer after the dipper is unloaded.

11. The method of claim 1, wherein deactivating the secondary tipping control operation includes increasing the deceleration ramp rate of the hoist motor immediately.

12. The method of claim 1, wherein deactivating the secondary tipping control operation includes increasing the acceleration ramp rate of the hoist motor gradually.

13. The method of claim 1, wherein determining when the dipper is unloaded includes monitoring the position of a dipper trip switch.

14. The method of claim 1, wherein determining when the dipper is unloaded includes monitoring a position and a state of the industrial machine.

15. The method of claim 14, wherein the state of the industrial machine include a dump state and a return state.

16. The method of claim 1, wherein controlling the speed, the acceleration ramp rate, and the deceleration ramp rate of the hoist motor includes using fixed parameters.

17. The method of claim 1, wherein controlling the speed, the acceleration ramp rate, and the deceleration ramp rate of the hoist motor includes using modifiable parameters.

18. The method of claim 1, wherein controlling the speed, the acceleration ramp rate, and the deceleration ramp rate of the hoist motor includes decreasing the speed, the acceleration ramp rate, and the deceleration ramp rate of the hoist motor.

19. The method of claim 1, wherein determining that the dipper is ready to be unloaded further includes determining that the dipper handle is extended at a predetermined handle threshold value.

20. The method of claim 19, wherein determining that the dipper is ready to be unloaded further includes determining a dipper handle angle.

21. A method of controlling a digging operation of an industrial machine, the industrial machine including a dipper connected to a dipper handle, a hoist rope attached to the dipper, and a hoist motor moving the hoist rope and the dipper, the method comprising:

determining that the dipper is in a position to be unloaded;

decreasing a speed of the hoist motor, decreasing an acceleration ramp rate of the hoist motor, decreasing a deceleration ramp rate of the hoist motor;

determining when the dipper is tripped;

increasing the acceleration ramp rate of the hoist motor; and increasing the deceleration ramp rate of the hoist motor.

22. The method of claim 21, wherein determining that the dipper is in a position to be unloaded further includes determining that the dipper is full.

23. The method of claim 21, wherein determining that the dipper is in a position to be unloaded further includes determining that a swing speed of the industrial machine is greater than a predetermined threshold.

24. The method of claim 21, wherein determining that the dipper is in a position to be unloaded further includes determining when an operator is requesting a full deceleration of the swing speed of the industrial machine.

25. The method of claim 21, wherein determining that the dipper is in a position to be unloaded further includes determining when the dipper is positioned over an unloading vehicle.

26. The method of claim 21, wherein determining that the dipper is in a position to be unloaded further includes determining that the industrial machine is in a swing state.

27. The method of claim 21, wherein determining that the dipper is in a position to be unloaded further includes determining that a hoist torque of the hoist motor is greater than fifty percent on average for a predetermined time period.

28. The method of claim 21, wherein determining that the dipper is in a position to be unloaded further includes determining that the dipper handle is extended at a predetermined handle threshold value.

29. The method of claim 28, wherein determining that the dipper is in a position to be unloaded further includes determining a dipper handle angle.

30. The method of claim 21, wherein determining when the dipper is tripped includes monitoring the position of a dipper trip switch.

31. The method of claim 21, wherein determining when the dipper is tripped includes monitoring a position and a state of the industrial machine, wherein the state of the industrial machine include a dump state and a return state.

32. The method of claim 21, wherein controlling the speed, the acceleration ramp rate, and the deceleration ramp rate of the hoist motor includes using modifiable parameters.

33. The method of claim 21, further comprising starting a predetermined timer after the dipper is unloaded.

34. The method of claim 21, further comprising deactivating the secondary tipping control operation including at least one of increasing the deceleration ramp rate of the hoist motor immediately and increasing the acceleration ramp rate of the hoist motor gradually.

* * * * *